US005699967A

United States Patent [19]

Conatser et al.

[11] Patent Number: 5,699,967

[45] Date of Patent: Dec. 23, 1997

[54] AIRLESS SPRAY GUN DIFFUSER

[75] Inventors: Roger Conatser, Franklin; Victor R. Jarboe, Lebanon, both of Tenn.

[73] Assignee: Campbell Hausfeld/Scott Fetzer Co., Westlake, Ohio

[21] Appl. No.: 519,631

[22] Filed: Aug. 25, 1995

[51] Int. Cl.[6] ..... B05B 9/01; B05B 1/32

[52] U.S. Cl. ..... 239/526; 239/583

[58] Field of Search ..... 239/119, 288, 239/288.3, 288.5, 526, 553.3, 553.5, 575, 583

[56] References Cited

U.S. PATENT DOCUMENTS 4,116,386 9/1978 Calder ..... 239/119
4,165,836 8/1979 Eull ..... 239/119
4,685,621 8/1987 Scherer et al. ..... 239/288
4,971,249 11/1990 Tam et al. ..... 239/119

*Primary Examiner*—Lesley D. Morris
*Attorney, Agent, or Firm*—Wood, Herron & Evans, L.L.P.

[57] ABSTRACT

An improved poppet valve seat having a predetermined through-bore restricting orifice operating in conjunction with a fluid diffuser and diffuser flow passages thereof reduce the velocity of fluid ejected from the spray gun below levels which are hazardous for potential injection into the skin of a user or the like when the spray tip and associated safety guards are removed from a spray gun. However, while the velocity of the paint passing through the spray gun is reduced to avoid the injection hazards, the atomization pressures required for cohesive and complete atomization of the fluid passing through the airless paint sprayer is maintained to provide an efficient and effective atomization of the fluid in an airless sprayer.

19 Claims, 2 Drawing Sheets

AIRLESS SPRAY GUN DIFFUSER

BACKGROUND OF THE INVENTION

This invention relates to airless spraying and more particularly to improvements in airless sprayers providing increased safety against accidental or unintentional fluid injection when the typical spray tips are removed from the airless spray guns.

In airless spraying, such as in spraying of paint for example, it is common to pump paint at high pressure through a high pressure flexible hose to a spray gun. From the hose entry into the gun, the paint or spray fluid is conducted to a trigger actuated popper valve. When the popper is opened, paint flows through the popper seat and to the spray tip or orifice where it is atomized for spraying. Typical pressures are in the neighborhood of about 1900 psi to about 2400 psi. A typical pressure would be, for example, about 2000 psi. The spray tip or orifice usually produces a pressure drop in the approximate range of about 2000 psi for efficient atomization of most paints.

In such guns, it is typical to provide a spray tip or orifice which is removable from the gun. When the spray tip is removed, the area of the gun immediately downstream of the poppet valve seat through-bore is exposed. Since removal of the tip for cleaning, replacement or the like also generally removes any protective guards, a person's hand, arm or other body part can be moved into close proximity to the poppet valve through-bore. If the trigger of the gun is actuated, it is possible that pressurized paint in the gun or its upstream paint delivery systems could be ejected from the gun with such force as to be injected into a person's skin.

This could result from a number of factors. For example, the flexible high pressure hose between the airless paint pump and the gun expands when the paint is pressurized by the pump. Even though the pump is stopped, paint may reside in the expanded hose under high maximum static pressures of about 2500 psi or so even though operating pressures are about 2000 psi or so. This stored energy could be released upon trigger actuation through the poppet valve and, if proximate to a human, inject the skin. Even though this stored energy is quickly released, in less than one second, ejection velocity and flow rates can be high, as much as 5 or 6 gallons per minute (gpm) over a short burst of a few milliseconds. The longer the delivery hose, the more energy that can be stored.

In one prior system, a bar is positioned in front of the paint orifice and the fluid flow is directed around the bar. However, the bar merely operates to redirect the flow path of the fluid and the flow stream of the fluid remains concentrated in flow paths on both sides of the bar. Accordingly, the energy of the paint or fluid is not diffused and the potential for injection of the high energy fluid into a human still exists with respect to either of the flow paths around the bar.

While it is thus desirable then to control fluid dispensing velocities from the gun when the spray tip or orifice is removed, it is also necessary to retain the substantive operating pressures at the tip when it is on the gun, so atomizing efficiency is not adversely affected. Thus devices inserted into the gun to reduce paint velocities also may produce such a pressure drop upstream of the spray tip that consistent atomization of paints at the tip may be impossible.

Accordingly, it has been one objective of this invention to provide an improved spray gun which eliminates, or at a minimum significantly reduces, the possibility that gun actuation with the spray tip removed could inject human skin proximate or next to the point from which paint is ejected from the gun.

Another objective of the invention has been to provide parts for a spray gun for reducing the possibility of fluid injection into human skin when the gun's spray tip is removed and the gun trigger actuated.

Another objective of the invention has been to provide an improved spray gun with reduced likelihood of fluid injection of a user's skin when the gun is actuated without the spray tip in place, while at the same time not adversely affecting the efficiency of the normal spray operation.

SUMMARY OF THE INVENTION

To these ends, a preferred embodiment of the invention includes an improved poppet valve seat having a predetermined through-bore or restricting orifice operating in conjunction with a flow diffuser and diffuser flow passages to reduce the velocity of fluid ejected downstream of the diffuser to a rate or velocity below that which will inject skin, yet not produce such a pressure drop as to undesirably affect spray tip atomization when the tip is on the gun. For these purposes, it has been discovered that the critical skin injection velocity for the fluid is about 70 feet per second or slightly less. Much above that, and fluid will inject skin.

Accordingly, the cross-sectional flow area of the poppet seat through-bore and the cross-sectional flow area through the diffuser are selected such that the velocity of paint or fluid exiting the diffuser is less than about 70 feet per second.

The actual popper seat through-bore and diffuser flow areas are selected, for example, such that the ratio of the cross-sectional flow area of the diffuser to the cross-sectional flow area of the poppet through-bore is more than about 2.5, and is preferably between about 2.5 and about 11. It will be appreciated that larger ratios of the cross-sectional flow areas are safer and more preferred if they can be obtained without detrimentally impacting the atomization of the fluid. For example, ratios on the order of 20 or more are preferred if pressure drops for atomization on the order of 2000 psi can be maintained.

Accordingly, in one specific embodiment of the invention, a poppet valve seat has a reduced diameter through-bore of about 0.070" and cross-sectional flow area of about 0.0038 square inches, and a diffuser is provided with two semi-circular, off-axis (from the through-bore) flow areas totaling about 0.044 square inches.

In accordance with the invention and in view of the desire to maintain paint or fluid pressure immediately upstream of the spray tip at a substantial pressure sufficient for efficient atomization, it is also desirable to limit the pressure drop across the poppet through-bore from about 50 psi to about 200 psi. Accordingly, where desirable atomization pressure drop is about 2000 psi, then the ratio of the pressure drop across the restricting orifice of the poppet seat to the pressure drop across the spray tip or orifice is from about 0.025 to about 0.1. Other pressure drops across the restricter and diffuser could be utilized within the scope of this invention provided that consistent flow and atomization parameters are obtained.

If paint or fluid in a working range of about 2000 psi is accidentally or unintentionally ejected through such a seat and diffuser, its velocity immediately downstream of the diffuser will be limited to about 70 feet per second or less, eliminating the injection of any adjacent skin by the ejected paint or fluid. A design safety factor of about four is preferably used to limit the fluid velocity to about 17.5 feet per second.

Of course, airless spray systems have many variables, such as differing spray tip or orifice sizes, hose lengths, pressurization and the like. Nevertheless, poppet throughbores and off-axis diffuser flow areas can be selected for airless spray systems, maintaining the ratio or velocity parameters noted above, to attain the same beneficial results of eliminating accidental or unintentional skin injection.

BRIEF DESCRIPTION OF THE DRAWINGS

The objectives and features of the invention will become more readily apparent from the following detailed description taken in conjunction with the accompanying drawings in which.

DETAILED DESCRIPTION

Figure 1:
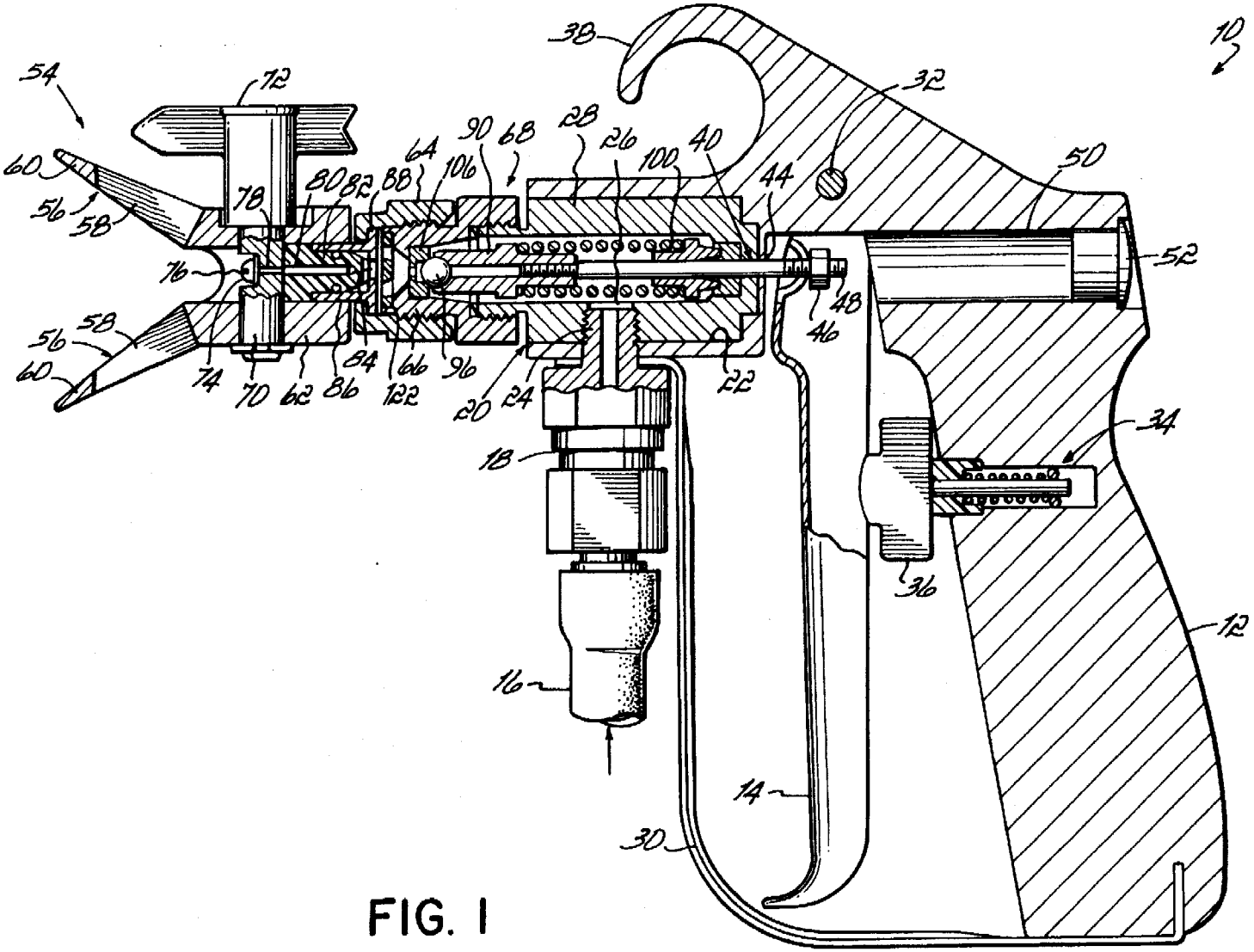
FIG. 1 is a cross-sectional view of a spray gun and attached spray tip according to a presently preferred embodiment of this invention.

Referring to FIG. 1, a presently preferred embodiment of an airless fluid spray gun 10 is shown. The spray gun 10 includes a handle 12 and a trigger 14 to be grasped by a user to actuate the sprayer and thereby project spray drawn from a paint source (not shown) through a feed hose 16 which is connected via a filter assembly 18 to the spray gun 10. The paint or other fluid is pressurized by a pump (not shown) of the airless paint sprayer and delivered through the feed hose 16 and the filter 18 to a gun valve assembly 20 which is friction fit within a counterbore 22 on the front end of the gun 10. A threaded fitting 24 on an uppermost end of the filter assembly 18 projects through a lower sidewall of the gun 10 forming the counterbore 22 to threadably engage a hole 26 in the bottom sidewall of a generally cylindrical gun insert 28 forming a part of the gun valve assembly 20.

The gun 10 also includes a generally L-shaped guard 30 separating the trigger 14 from the hose 16 and filter assembly 18, The trigger 14 is pivotally coupled at its upper end to a pin 32 mounted in the gun 10. A locking assembly 34 includes a bushing 36 which contacts a rear edge of the trigger 14. The locking assembly 34 enables the trigger 14 to be locked into closed or open positions as appropriate. Projecting upwardly from an upper edge of the gun 10 is a hook-shaped gun grip 38.

Figure 2:
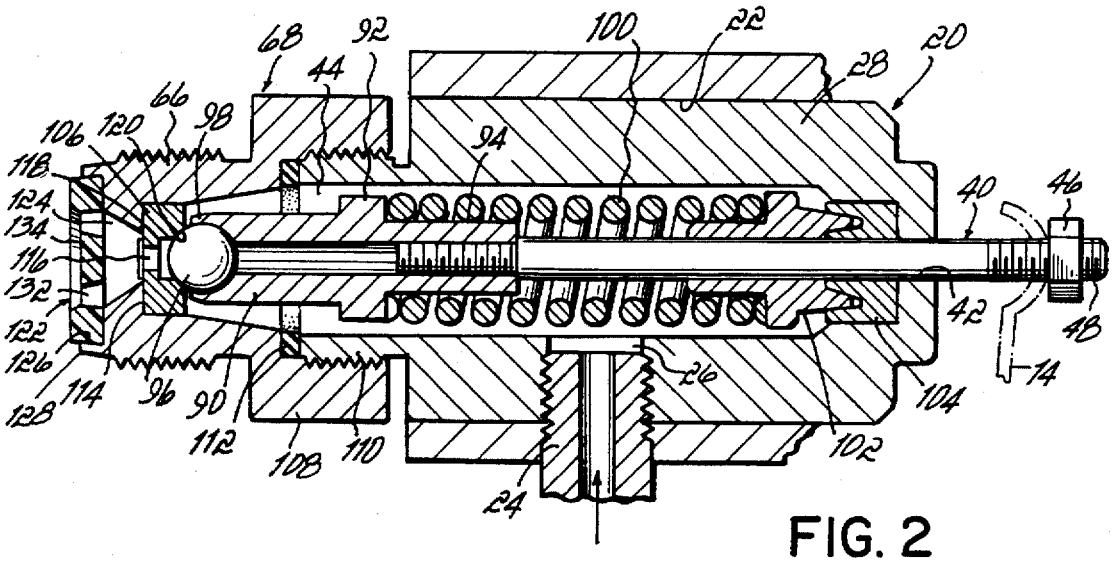
FIG. 2 is an enlarged cross-sectional view of the gun valve assembly of FIG. 1.

The gun valve assembly 20 includes an elongated generally cylindrical needle 40 projecting axially through the counterbore 22. (FIGS. 1 and 2.) The needle 40 extends through a hole 42 in the back wall of the gun insert 28 and projects through a hole 44 in the gun 10 proximate the upper end of the trigger 14. A stop nut 46 is provided on a threaded end portion 48 of the needle 40 to retain the upper end of the trigger 14 into engagement with the needle 40. A bore 50 extends rearwardly through the upper portion of the handle 12 and provides access to the stop nut 46 for adjustments as is known in the art. A removable cap or plug 52 is provided at the rear end of the bore 50 for closure thereof.

The gun 10 includes a spray tip 54 on a front end thereof through which the paint or fluid is sprayed and atomized for application to a surface to be painted. The spray tip 54 includes upper and lower guards 56 each of which includes a pair of arms 58 connected to the opposing ends of a cross bar 60. The guards 56 project angularly upwardly or downwardly from a block 62 which has a fitting 64 mounted for rotation relative thereto on a back end thereof. The fitting 64 is threadably coupled to a forwardly projecting flange 66 of a poppet seat assembly 68. A rotating post 70 projects vertically through the block 62 and has a grip/indicia 72 on an upper end thereof, The grip/indicia 72 is grasped by the user to rotate the post 70 through 180° from a spraying position (shown in FIG. 1) to a cleaning position (not shown). The post 70 includes a spray head 74 with an orifice 76 therein through which the paint is ejected and atomized for spraying. The orifice 76 in the spray head 74 may have any required shape but is no greater than about 0.019 inches equivalent orifice diameter in a preferred embodiment for reasons to be described in detail later herein, The spray head 74 is in communication with a duct 78 in the post 70 and a passageway 80 in an insert 82 within the block 62. The passageway 80 is open to a hole 84 in a boss 86 having a lip 88 to retain the fitting 64 and permit rotation of the fitting 64 relative to the block 62 for screwing the fitting 64 onto the poppet seat assembly 68.

The guards 56 and spray tip 54 according to a presently preferred embodiment of this invention are well known in the art and are provided to inhibit the user's or someone else's body part from coming in contact with the spray exiting the spray gun 10 to avoid an injection hazard. However, periodically the spray tip 54 must be removed for cleaning or replacement by unscrewing the fitting 64 from the poppet seat flange 66. The potential for a person's hand, arm, or other body part to be moved into close proximity with the pressurized spray exiting the gun 10 is increased because the guards 56 are removed with the spray tip 54. If the trigger 14 of the gun 10 is actuated, it is possible the pressurized paint in the gun 10 or its upstream paint delivery systems could be ejected from the gun 10 with such force as to be injected into a person's skin. Therefore, this invention provides a system whereby even with the spray tip 54 and guards 56 removed, the velocity of the paint exiting the spray gun 10 is below that which may be required to inject the paint into a person's skin while still maintaining efficient and cohesive atomization of the paint or fluid passing through the gun 10 and attached spray tip 54.

Referring particularly to FIG. 2, the gun valve assembly 20 includes the generally cylindrical shaped gun insert 28 as previously described with the needle 40 projecting axially therethrough. A ball retainer 90 is secured to the end of the needle 40 opposite the stop nut 46 and includes a flange 92 projecting radially outward at a mid-portion thereof and a rearwardly extending stem 94 which is secured to the needle 40. A ball 96 is securely held by the ball retainer 90 in which the forwardmost edges 98 thereof are crimped around the ball 96. A spiral compression spring 100 is mounted concentrically around the needle 40 and at a first end is juxtaposed to the flange 92 on the ball retainer 90 and around the rearwardly extending stem 94 thereof and at a second end is seated on a rear retainer 102 which is mated with a seal 104 proximate the back wall of the gun insert 28, The needle 40 projects through the rear retainer 102 and seal 104 and through the hole 42 in the back wall of the gun insert 28.

The spiral compression spring 100 biases the ball retainer 90 and ball 96 forwardly into contact with a poppet seat 106 retained within the seat assembly 68 attached to the front end of the gun insert 28. A rearwardly extending collar 108 of the seat assembly 68 is threadably connected to a forwardly extending flange 110 on the gun insert 28, An annular rubber seal 112 is provided between the juncture of the forward flange 110 on the gun insert 28 and the rearward collar 108 on the seat assembly 68 to prevent leaks of the paint or fluid flowing therebetween. The poppet seat 106 is press fit into a well 114 in the seat assembly 68 and includes a through-bore. The through-bore has a first smaller diameter restricting orifice 116 proximate a front edge of the poppet seat 106 and a second larger diameter orifice 118 proximate the rear edge of the poppet seat 68. The smaller diameter restricting orifice 116 on the front edge of the poppet seat 68 has a through bore diameter of about 0.070 inches and a cross-sectional flow area of about 0.0038 square inches in a presently preferred embodiment. The larger diameter orifice 118 of the through bore includes a beveled lip 120 proximate the rear edge which provides a seat for the ball 96 to contact the poppet seat 106. The ball 96 is biased forwardly into the poppet seat 106 to provide a seal preventing the flow of paint from the gun insert 28 through the seat assembly 68.

Figure 3:
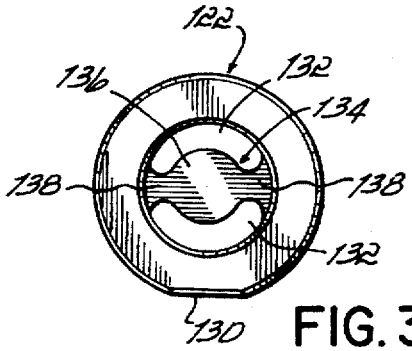
FIG. 3 is an elevational view of the diffuser of FIGS. 1 and 2.

A diffuser 122 is provided on the forwardmost edge of the seat assembly 68 and is shown particularly in FIGS. 2 and 3. The diffuser 122 is positioned downstream from an outwardly tapered passage 124 in the seat assembly 68 and is heed in a socket 126 on the front end of the seat assembly proximate the boss 86 in the spray tip 54. The diffuser 122 is retained in the socket 126 by inwardly turned or crimped lips 128 on the socket 126. The diffuser 122, as particularly shown in FIG. 3, is generally circular and has an outer diameter of 0.52 inches and is 0.10 inches thick in the presently preferred embodiment. The diffuser 122 is preferably injection molded nylon 30–33% glass and may include a flattened portion 130 so that any protrusion of gate vestige from the molding process does not inhibit it from seating within the socket 126. The diffuser 122 includes a pair of semi-circular flow areas 132 each about 0.022 square inches. Therefore, the total flow area through the diffuser 122 in a presently preferred embodiment is 0.044 square inches. The semi-circular flow areas 132 in combination have an outer diameter of 0.299 inches with a center bridge member 134 separating the flow areas 132 in which the bridge member 134 has a generally circular core 136 with a diameter of 0.170 inches and tapered stems 138 extending from opposing sides of the core 136 to form the semi-circular flow areas 132. The stems 138 are approximately 0.63 inches in width. The outermost edges of each flow area 132 are generally perpendicular to the face of the diffuser 122 whereas the sides of the core 136 of the bridge member 134 are tapered at an angle of 73° with respect to the front face of the diffuser 122 (FIG. 2) for manufacturing and fluid flow purposes.

For normal operation of the spray gun 10 of the airless paint sprayer according to this invention, paint is supplied to the gun 10 at a pressure range typically between 1900–2400 psi and preferably about 2000 psi through the supply hose 16 and the filter assembly 18. The paint flows into the hole 26 in the bottom sidewall of the gun insert 28 and then into the counterbore 22 extending through the gun assembly 20 and around the spring 100 and ball retainer 90. When the trigger 14 is actuated by the user, the needle 40 retracts and compresses the spring 100 thereby pulling the ball retainer 90 and ball 96 captured on the front end thereof rearwardly out of sealing contact with the poppet seat 106. With the ball 96 retracted from the poppet seat 106, the paint flows into and through the through bore and restricting orifice 116 of the poppet seat 106 and into the tapered passage 124 on the front end of the seat assembly 68. The paint then impacts the circular core 136 of the bridge 134 and is diverted into the diffuser flow areas 132. The diffuser flow areas 132 are preferably off-axis from the restricting orifice 116 of the poppet seat 106. As a result, the paint flow changes direction as it passes from the poppet seat 106 to the diffuser 122 and the diffuser 122 to the spray tip 54 in order to reduce its velocity without creating large pressure drops. The paint flows through the semi-circular flow areas 132 of the diffuser 122 and into the spray tip 54 for application onto the surface to be painted during normal operations. Preferably according to this invention, the paint flow through the diffuser off-axis flow areas 132 is evenly distributed within the flow areas 132 to minimize potential injection velocity unlike known diffuser spray systems. For proper atomization and spraying, the pressure drop of the paint exiting the spray tip 54 is preferably at least 2000 psi.

It will be appreciated that the paint feed hose 16 is a flexible high pressure hose connecting the airless paint pump and the spray gun 10 so that the hose 16 may expand when the paint is pressurized by the pump. Even though the pump may be stopped, paint residing in the expanded hose 16 will be under a high maximum static pressure of about 2500 psi or greater even though the operating pressure for atomization is 2000 psi or so. The stored energy could be released upon trigger 14 actuation and, if proximate to a human, inject the skin. If the spray tip 54 is removed for cleaning, replacement or the like, pressurized paint within the system can still flow through the gun valve assembly 20 and spray through the poppet seat 106 and diffuser 122. Even though the stored energy of the fluid is quickly released, in less than one second or so, flow rates can be high, as much as 5 or 6 gallons per minute of very short bursts of a few milliseconds. It will be appreciated that the longer the supply hose 16, the more energy that can be stored therein creating an even greater injection hazard. However, the scope of this invention is not limited to a feed hose of any particular length or pressure rating.

According to this invention, the paint flows through the gun valve assembly 20 to be discharged from the gun 10 with the spray tip 54 removed and an injection hazard is avoided due to the relationship between the diffuser 122 and the poppet seat 106 and the velocity of the paint delivered through the gun 10. The relationship between the restricting orifice 116 of the through-bore and the flow areas 132 of the diffuser 122 operate in conjunction to reduce the velocity of the paint passing therethrough to a velocity below that which will provide an injection hazard while still enabling a sufficient pressure drop to efficiently and coherently atomize the paint for spraying. It has been discovered that the critical skin injection velocity is about 70 feet per second. Much above that, the fluid will inject the skin. One aspect of the present invention is to provide a safety factor, preferably of about 4, so that the velocity of fluid or paint exiting the spray gun 10 is approximately 17.5 feet per second. Accordingly, the cross-sectional flow area of the restricting orifice 116 of the poppet seat 106 through bore and the cross-sectional flow areas 132 of the diffuser 122 are selected such that the velocity of the paint exiting the diffuser 122 is approximately 17.5 feet per second in a presently preferred embodiment.

The ratio between the cross-sectional flow areas of the restricting orifice 116 of the through-bore on the poppet seat and the diffuser 122 is preferably more than about 2.5 and is most preferably between about 2.5 and about 11. However, in a still more preferred embodiment, larger ratios of the cross-sectional flow areas provide an even reduced risk of skin injection and a safer operating spray gun 10. As a result, it will be appreciated that higher ratios are more preferred if they can be obtained without detrimental impact to the atomization of the paint or fluid. For example, ratios on the order of 20 or more are preferred if the pressure drops for atomization on the order of 2000 psi can still be maintained at the spray tip 54.

In accordance with this invention and in view of the desire to maintain paint or fluid pressure immediately upstream of the spray tip 54 of a sufficient level for atomization, it is also desirable to limit the pressure drop across the poppet seat 106 from about 50 psi to about 200 psi. The spray orifice 76 is preferably no greater than 0.019 equivalent orifice diameter with a restricting orifice 116 diameter of about 0.070 inches. Otherwise, if the restricting orifice 116 size approaches the spray orifice 76 size then the pressure drop across the poppet seat 106 is too large and the preferred pressure drop for atomization of about 2000 psi at the spray tip 54 cannot be achieved. Accordingly, the desirable atomization pressure drop is about 2000 psi, and the ratio of the pressure drop of the paint or fluid across the through-bore of the popper seat 106 to the pressure drop across the spray tip 54 or orifice 76 of the spray gun 10 is about 0.025 to 0.1. It will be appreciated that other pressure drops across the poppet seat 106 and diffuser 122 and other sizes for the respective orifices could be utilized within the scope of this invention provided the consistent flow and coherent atomization of the fluid is maintained. As a result of the diffuser 122 and spray gun 10 of this invention, if paint or fluid in a working range of approximately 2000 psi is accidentally or unintentionally ejected from the spray gun 10 without the spray tip 54 and associated safety guards 56, its velocity immediately downstream of the diffuser 122 will be limited to well below 70 feet per second or less, preferably about 17.5 feet per second with a safety factor of 4 according to the presently preferred embodiment of the invention, thereby avoiding the injection of any adjacent skin by the paint or fluid.

Further, the diffuser 122 and spray gun 10 according to this invention while avoiding the risk of injection still maintain an efficient and cohesive atomization spray passing through the flow areas 132 of the diffuser 122 and into the spray tip 54.

From the above disclosure of the general principles of the present invention and the preceding detailed description of a preferred embodiment, those skilled in the art will readily comprehend the various modifications to which this invention is susceptible. Therefore, I desire to be limited only by the scope of the following claims and equivalents thereof.

I claim:

1. In an airless fluid spray gun having a fluid valve and a removable spray orifice for atomizing fluid in a spray pattern:

a restricting orifice downstream of said valve; and a diffuser having at least one fluid flow area therethrough downstream of said restricting orifice;

said restricting orifice and said diffuser producing in combination a fluid flow immediately downstream of said diffuser, when said spray orifice is removed from said gun, said fluid flow having a velocity of less than about 70 feet per second.

2. Apparatus as in claim 1 wherein said diffuser has multiple flow areas having a combined first cross-sectional area and said restricting orifice has a second cross-sectional area, and wherein the ratio of said first area to said second area is greater than about 2.5.

3. Apparatus as in claim 2 wherein the fluid flow area ratio is between about 2.5 and about 11.

4. Apparatus as in claim 1 wherein fluid flow through said diffuser flow areas is generally evenly distributed.

5. In an airless fluid spray gun having a fluid valve and a removable spray orifice for atomizing fluid in a spray pattern:

a restricting orifice downstream of said valve: and a diffuser having at least one fluid flow area therethrough downstream of said restricting orifice;

said restricting orifice and said diffuser producing in combination a fluid flow immediately downstream of said diffuser, when said spray orifice is removed from said gun, said fluid flow having a velocity of less than about 70 feet per second, wherein there is a pressure drop in said gun across said spray orifice when said gun is operated with said spray orifice thereon, wherein there is also a pressure drop across said restricting orifice and a ratio of the pressure drop across said restricting orifice to the pressure drop across said spray orifice is within the range of about b 0.025to about 0.10.

6. Apparatus as in claim 5 wherein said pressure drop ratio is about 0.10.

7. Apparatus as in claim 1 wherein said fluid flow velocity is about 15 to about 20 feet per second.

8. In an airless fluid spray gun having a fluid valve and a removable spray tip for atomizing fluid in a spray pattern:

a restricting orifice upstream of said tip;

a diffuser between said restricting orifice and said tip;

said diffuser and said restricting orifice having respective first and second cross-sectional flow areas; and a ratio of said first flow area to said second flow area being more than about 2.5.

9. Apparatus as in claim 8 wherein said ratio is in the range of about 2.5 to about 11.

10. Apparatus as in claim 9 wherein a velocity of fluid exiting said diffuser upon gun actuation when said spray tip is removed is less than about 70 feet per second.

11. Apparatus as in claim 10 wherein said fluid flow velocity is about 15 to about 20 feet per second.

12. Apparatus as in claim 8 wherein fluid flow through said diffuser flow area is generally evenly distributed.

13. In an airless fluid spray gun having a fluid valve and a removable spray orifice for atomizing fluid in a spray pattern:

a restricting orifice upstream of said spray orifice;

a diffuser between said restricting orifice and said spray orifice;

said diffuser and said restricting orifice having respective first and second cross-sectional flow areas;

a ratio of said first flow area to said second flow area being more than about 2.5;

said restricting orifice producing a first pressure drop in fluid moving therethrough;

said spray orifice producing a second pressure drop in fluid moving therethrough; and a ratio of said first pressure drop to said second pressure drop being in the approximate range of from about 0.025 to about 0.10.

14. Apparatus as in claim 13 wherein a velocity of fluid exiting said diffuser upon gun actuation when said spray orifice is removed is less than about 70 feet per second.

15. Apparatus as in claim 14 wherein said fluid flow velocity is about 15 to about 20 feet per second.

16. In combination a fluid flow restricter and a fluid diffuser for an airless fluid spray gun having a spray tip, said restricter and said diffuser being adapted for disposition in said spray gun upstream of said spray tip, said diffuser having a first cross-sectional flow area and said restricter having a second cross-sectional flow area wherein a ratio of said first flow area to said second flow area is greater than about 2.5.

17. In combination a fluid flow restricter and a fluid diffuser for an airless fluid spray gun having a spray tip, said restricter and said diffuser being adapted for disposition in said spray gun upstream of said spray tip, said diffuser having a first cross-sectional flow area and said restricter having a second cross-sectional flow area wherein a ratio of said first flow area to said second flow area is greater than about 2.5, wherein said restricter produces a first pressure drop in fluid passing therethrough and said spray tip produces a second pressure drop in fluid passing therethrough, a ratio of said first pressure drop to said second pressure drop is from about 0.025 to about 0.1.

18. Combination as in claim 17 wherein said second pressure drop is at least about 2000 psi.

19. Combination as in claim 16 wherein said first cross-sectional flow area is about 0.044 square inches and said second cross-sectional flow area is about 0.0038 square inches and said spray tip has an equivalent orifice diameter no greater than about 0.019 inches.

* * * * *

UNITED STATES PATENT AND TRADEMARK OFFICE

CERTIFICATE OF CORRECTION

PATENT NO. : 5,699,967

DATED : December 23, 1997

INVENTOR(S) : Roger Conatser & Victor Raymond Jarboe

It is certified that error appears in the above-indentified patent and that said Letters Patent is hereby corrected as shown below:

Column 5, Line 19, "is heed" should read -- is held--.

Column 8, Line 12, "about b 0.025" should read --about 0.025--.

Signed and Sealed this

Fourteenth Day of April, 1998

Bruce Lehman

*Attest:*

BRUCE LEHMAN

*Attesting Officer*

*Commissioner of Patents and Trademarks*